US007458739B2

(12) United States Patent
Akaiwa

(10) Patent No.: US 7,458,739 B2
(45) Date of Patent: Dec. 2, 2008

(54) APPARATUS FOR PROCESSING TARGET SHEET AND METHOD OF CONTROLLING EMBOSSING BY APPARATUS FOR PROCESSING TARGET SHEET

(75) Inventor: Masao Akaiwa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 624 days.

(21) Appl. No.: 11/109,423

(22) Filed: Apr. 19, 2005

(65) Prior Publication Data

US 2006/0000372 A1 Jan. 5, 2006

(30) Foreign Application Priority Data

Jun. 30, 2004 (JP) ..... 2004-194217

(51) Int. Cl.
*B41J 29/38* (2006.01)
*B41J 3/32* (2006.01)

(52) U.S. Cl. ..... 400/76; 400/109.1

(58) Field of Classification Search ..... None
See application file for complete search history.

(56) References Cited

U.S. PATENT DOCUMENTS 3,559,568 A * 2/1971 Stanley ..... 101/32
6,086,273 A * 7/2000 Hong ..... 400/109.1
2006/0017943 A1* 1/2006 Kurashina ..... 358/1.5
2006/0193669 A1* 8/2006 Takada et al. ..... 400/109.1
2006/0228145 A1* 10/2006 Takada et al. ..... 400/109.1

FOREIGN PATENT DOCUMENTS

JP 02-303875 12/1990
JP 3054580 9/1998
JP 2003154752 A * 5/2003

OTHER PUBLICATIONS

Machine translation of JP 2003154752, to Furuyama et al., from Japanese Patent Office website.*

* cited by examiner

*Primary Examiner*—Daniel J Colilla
(74) *Attorney, Agent, or Firm*—Hogan & Hartson LLP

(57) ABSTRACT

In processing a target sheet, raised letters (Braille) are formed by selectively driving a plurality of embossing pins arrayed in a direction perpendicular to a direction of feeding the target sheet such that the raised letters are represented in a projected bit pattern which is embossed at embossing points of a plurality of stages in two rows. Embossing operation is performed on the target sheet based on the emboss-inspection pattern which is made up of a repetition of the bit pattern. This emboss-inspection pattern facilitates to identify the cause of troubles, if any, in the embossing system.

9 Claims, 12 Drawing Sheets

1ST LAYOUT (NOTE: transliteration of Japanese "hiragana"; raised letters represent those of hiragana)

2ND LAYOUT

3RD LAYOUT

4TH LAYOUT

5TH LAYOUT

1ST EMBOSS-INSPECTION PATTERN

2ND EMBOSS-INSPECTION PATTERN

3RD EMBOSS-INSPECTION PATTERN

4TH EMBOSS-INSPECTION PATTERN

DISPLAY SCREEN

APPARATUS FOR PROCESSING TARGET SHEET AND METHOD OF CONTROLLING EMBOSSING BY APPARATUS FOR PROCESSING TARGET SHEET

BACKGROUND OF THE INVENTION

1. Field of the Invention

This invention relates to an apparatus for processing a target sheet which apparatus performs embossing of raised letters (i.e., Braille) and/or printing of written letters (i.e., letters printed with ink, or the like) on a piece of target sheet to be processed. The term "target sheet" in this specification means a sheet or a piece of paper which is made an object or target of processing such as printing and/or embossing. This invention also relates to a method of controlling the embossing thereof.

2. Description of the Related Art

Recently, there can be seen raised-letter labels containing raised-letter information such as a destination, an exit therefor, or the like, on information boards, or the like, at a railroad station in order to assist in the town those who are handicapped in eyesight. This kind of raised-letter labels are conventionally manufactured in the following manner. Namely, a plurality of push pins (embossing pins) are selectively driven to form projections (embossed projections) of raised letters on a label by feeding the label (target sheet) through a raised-letter label writer (target sheet processing apparatus).

In this kind of raised-letter label writer, when a trouble occurs to the embossing operation, an inspection of the embossing operation is made at a repair shop. However, since the trouble of embossing operation is attributable to various causes such as those due to a trouble in the embossing system, those due to a trouble in the label feeding system, those due to a trouble in the electrical (control) system, or the like, there is a problem in that the identification of the trouble and adequate repair thereof require a skill.

SUMMARY OF THE INVENTION

In view of the above problem, this invention has an advantage of providing: an apparatus for processing a target sheet and a method of controlling embossing thereby in which a point of trouble in the embossing operation for forming raised letters can be identified without the need of a skill.

According to one aspect of this invention, there is provided an apparatus for processing a target sheet comprising: embossing means for embossing raised letters on the target sheet to be fed, the raised letters being formed by selectively driving a plurality of embossing pins arrayed in a direction perpendicular to a direction of feeding the target sheet such that the raised letters are represented in a projected bit pattern which is embossed at embossing points of a plurality of stages in two rows; emboss-inspection mode setting means for setting an emboss-inspection mode in which inspection is made whether an embossing operation for forming the raised letters is normal or not; emboss-inspection pattern storing means for storing an emboss-inspection pattern which is made up of a repetition of a predetermined bit pattern; and control means for controlling the embossing means to perform embossing operation based on the emboss-inspection pattern when the emboss-inspection mode is set.

According to another aspect of this invention, there is provided a method of controlling embossing by an apparatus for processing a target sheet in which raised letters are formed by selectively driving a plurality of embossing pins arrayed in a direction perpendicular to a direction of feeding the target sheet such that the raised letters are represented in a projected bit pattern which is embossed at embossing points of a plurality of stages in two rows. The method comprises controlling the embossing means to perform embossing operation based on the emboss-inspection pattern which is made up of a repetition of the bit pattern.

According to the above arrangement, the embossing operation is performed on the target sheet based on the emboss-inspection pattern which is made up of a repetition of the predetermined bit pattern. Therefore, points of irregularities can be easily identified based on the result of irregular embossing such as continuous failure in embossing, gradual decrease in embossed height, positional deviation in the embossed projections, or the like. Specifically, in case of continuous failure in embossing, there can be estimated a mechanical trouble in the control system or the embossing system; in case of the gradual decrease in the embossed height, there can be estimated a trouble in the embossing system; and in case of the positional deviation in the embossed projections, there can be estimated a trouble in the embossing system or in the target-sheet feeding system. As a result, the repairing of the apparatus can be efficiently performed.

Preferably, the apparatus further comprises printing means for printing on the target sheet to be fed. When the emboss-inspection mode is set, the control means controls the embossing means and the printing means to thereby cause the embossing operation to be performed based on the emboss-inspection pattern, and cause the printing operation to be performed based on a print-inspection pattern which is equal to the emboss-inspection pattern.

According to this arrangement, the printing operation is performed based on the print-inspection pattern that is the same as the emboss-inspection pattern. Therefore, the target sheet to be processed has embossed thereon the emboss-inspection pattern and has also printed thereon the print-inspection pattern that is the same as the embossed emboss-inspection pattern. As a result, by comparing the embossed emboss-inspection pattern and the printed print-inspection pattern, it can be easily determined as to whether the embossing operation has been surely performed or not based on the given emboss-inspection pattern.

Preferably, the apparatus further comprises: embossing-region setting means for setting a position of an embossing region in which the embossing operation is performed on the target sheet; and printing-region setting means for setting a printing region in which the printing operation is performed on the target sheet.

According to this arrangement, when a comparison is made between the embossed emboss-inspection pattern and the printed print-inspection pattern, the embossing region and the printing region can be disposed at an arbitrary position, such as on an upper-and-lower positional relationship, left-and-right positional relationship, at the same position, or the like, to facilitate the comparison between the embossed region and the printed region.

Preferably, the emboss-inspection pattern storing means stores therein plural kinds of the emboss-inspection patterns. The apparatus further comprises selecting means for selecting one emboss-inspection pattern out of the plural kinds of emboss-inspection patterns, and the control means controls the embossing operation based on the emboss-inspection pattern selected by the selecting means.

According to this arrangement, by selecting an arbitrary one out of the plural kinds of emboss-inspection patterns defined in advance, the emboss-inspection pattern can be easily and quickly set, resulting in an improvement in the ease of operation of the apparatus by the user.

Preferably, emboss-inspection patterns for identifying the trouble in the control system and emboss-inspection patterns for identifying the trouble in the embossing system are prepared.

Preferably, the plural kinds of emboss-inspection patterns include one in which the bit pattern thereof embosses, out of the embossing points of a plurality of stages in two rows, at the embossing point of an arbitrary stage of each row.

According to this arrangement, embossing is made repeatedly by an arbitrary embossing pin without rest. Therefore, in case of a trouble in the embossing system for driving the embossing pins, there can be obtained an embossed result in that the height of the embossed projections becomes uneven when the embossing operation is performed based on this emboss-inspection pattern. This emboss-inspection pattern is thus particularly effective in identifying the trouble in the embossing system.

Preferably, the plural kinds of emboss-inspection patterns include one in which the bit pattern thereof embosses at all of the embossing points of the plurality of stages in two rows.

According to this arrangement, all the embossing pins emboss at the same time and each of the embossing pins repeatedly embosses without rest. Therefore, in case of a trouble in the signal system for controlling the driving of a particular embossing pin or in the embossing system of a particular embossing pin, there can be obtained an embossed result in that the embossing only by that particular embossing pin is not properly performed when the embossing operation is performed based on the emboss-inspection pattern. This emboss-inspection pattern is thus particularly effective in identifying the trouble in the control system or in the embossing system (particularly, the solenoid).

Preferably, the plural kinds of emboss-inspection patterns include one in which the bit pattern thereof embosses, out of the embossing points of a plurality of stages in two rows, at the embossing points of all stages of one row.

According to this arrangement, all of the embossing pins emboss at an equal interval at the same time. Therefore, in case of a trouble in the target-sheet feeding system in which the target sheet is not fed at a certain constant speed, or in case of a trouble in which the embossing pin does not return properly after having projected for embossing even where there is no trouble in the target-sheet feeding system, thereby resulting in a problem in that the head portion of the embossing pin gets hung (or stuck) in the rear recessed portion of the embossed projection just formed, the following embossed result will be obtained. Namely, if the embossing operation is performed based on this emboss-inspection pattern, the target sheet is not fed at a certain constant speed even if the embossing pins do perform the embossing at an equal pitch, thereby resulting in that the embossed projections are formed in a manner offset in the direction of feeding of the target sheet. This emboss-inspection pattern is thus particularly effective in identifying the trouble in the target-sheet feeding system or in the embossing system.

Preferably, the plural kinds of emboss-inspection patterns include one in which the bit pattern thereof embosses, out of the embossing points of a plurality of stages in two rows, at the embossing point or points of an arbitrary one or a plurality of stages in the first row and embosses at remaining embossing point or points of other stage in the second row.

According to this arrangement, an arbitrary embossing pin or a plurality of embossing pins (e.g., the embossing pin of the second stage) emboss the first row and the other embossing pin or pins emboss the second row. The embossing pin of the second stage and the other embossing pins emboss alternately and at an equal pitch. Therefore, in case of a trouble in which the target sheet is not properly fed because the forward and backward (on and off) movement of a particular embossing pin (e.g., the embossing pin of the second stage) is not properly performed, there can be obtained the following embossed result. Namely, if the embossing operation is performed based on this emboss-inspection pattern, the distance between the embossed projection of the first row and the embossed projection of the second row within the same frame becomes smaller than an ordinary embossing pitch (i.e., the pitch between rows). On the other hand, the distance between the embossed projection of the second row and the embossed projection of the first row of the adjoining frame becomes equal to the ordinary embossing pitch. In other words, the way of deviation becomes different between the case of a trouble in the target-sheet feeding system and the case of a trouble in the embossing system. As a result, this emboss-inspection pattern is effective in identifying as to in which of the target-sheet feeding system and the embossing system the trouble lies, or in identifying in which embossing of the embossing pins the trouble lies.

BRIEF DESCRIPTION OF THE DRAWINGS

The above and other objects and the attendant features of this invention will become readily apparent by reference to the following detailed description when considered in conjunction with the accompanying drawings wherein.

DETAILED DESCRIPTION OF THE PREFERRED EMBODIMENTS

With reference to the accompanied drawings, a description will now be made about an apparatus for manufacturing a label to which the apparatus for processing a target sheet according to this invention is applied. This label forming apparatus performs embossing of raised letters and/or printing of written letters on a raised-letter tape (i.e., a tape for embossing raised letters thereon) to thereby manufacture a label in which raised letters and/or written letters are represented. Therefore, a brief description will first be made about raised letters which are to be embossed on the raised-letter tape by the label forming apparatus.

Figure 1:
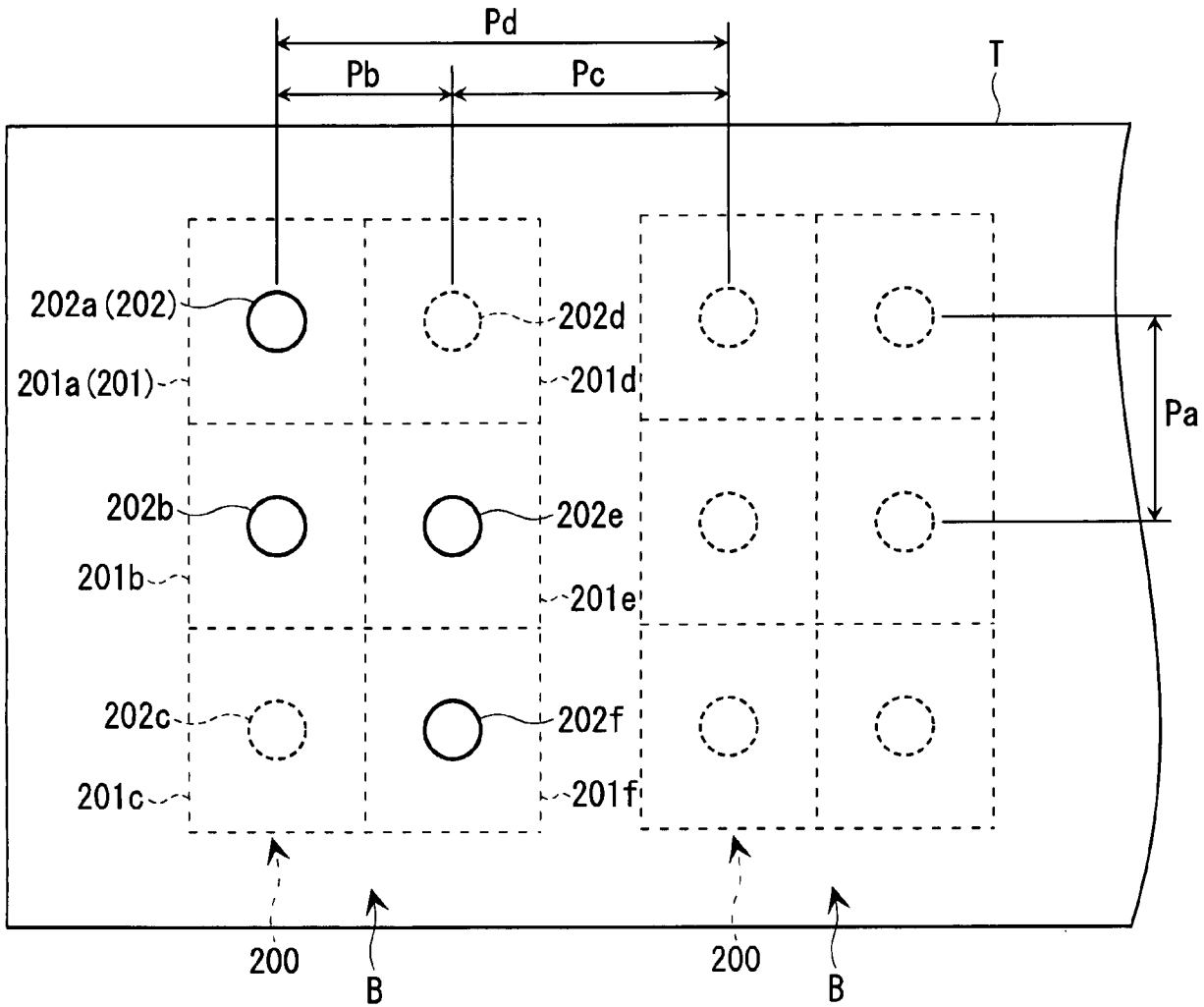
FIG. 1 is a plan view explaining a raised letter embossed on a raised-letter tape.

FIG. 1 is a schematic view explaining a raised letter B (i.e., six-point raised letter representing Japanese hiragana "SHI") embossed on the raised-letter tape T. (Note: In the following raised-letter examples, Japanese character or characters are used in the form of transliteration into alphabets to avoid the use of Japanese characters in the specification and figures; raised letters represent those of the Japanese character or characters.) As shown therein, the raised letter B is represented by a bit pattern of embossed projections 202 which are embossed at embossing points 201 of three stages in two rows (three pieces in vertical direction as arranged in two rows in horizontal direction) in each frame 200 (each frame representing one letter or attributes such as voiced sounds). In other words, the raised letter B is made up of a frame 200 which is divided into six embossing points 201*a*-201*f* having array pattern of three vertical stages in two horizontally separated rows. When a Japanese hiragana "SHI" is represented, four embossing points 201*a*, 201*b*, 201*e* and 201*f* are selectively embossed out of the six embossing points 201*a*-201*f*, thereby forming four embossed projections 202*a*, 202*b*, 202*e*, 202*f*. In the figure, the embossed points (embossed projections 202) are shown in solid circles and non-embossed points are shown in dotted lines.

Out of the six embossed projections 202 which constitute the bit pattern, the pitch (vertical pitch Pa) of the vertically arrayed embossed projections 202 is, e.g., about 2.4 mm. The pitch of the laterally arrayed two embossed points 202 (pitch between rows, Pb) is, e.g., about 2.1 mm. The pitch between the embossed projections 202 in the adjoining frame 200 (pitch between frames, Pc) is, e.g., about 3.3 mm. The pitch between the adjoining embossed letters B (pitch between embossed letters, Pd) is equal to the sum (e.g., about 5.4 mm) of the pitch between rows Pb and the pitch between frames Pc.

Even if the embossed projection 202 has a height of about 0.1 mm, it does not always follow that it cannot be recognized. The height of about 0.2 mm, however, gives only a too small a stimulation to those who have lost their eyesight in the course of life. The height of above 0.6 mm, on the other hand, will give too strong a stimulus and is likely to give way because the embossed projection 202 is not physically strong enough. Therefore, the height of the embossed projection 202 is preferably set to a range of 0.3 mm and 0.5 mm.

As the raised letters B, the above-described six-point raised letters are ordinarily used to represent the Japanese kana-letters ("hiragana" and "katakana"), numerals, or the like. Eight-point raised letters are also used to represent Chinese characters by means of a bit pattern of embossed projections as embossed on the embossing points of four stages in two rows. The label forming apparatus in this embodiment is intended to emboss only six-point raised letters, but there may be employed an arrangement in which eight-point raised letters can also be embossed.

A description will now be made about the label forming apparatus according to this invention. This label forming apparatus is arranged to perform embossing operation to emboss the raised letters and/or to print the written letters based on the inputted character information, thereby forming a label. It is also arranged to perform embossing operation based on a given emboss-inspection patterns.

Figure 2:
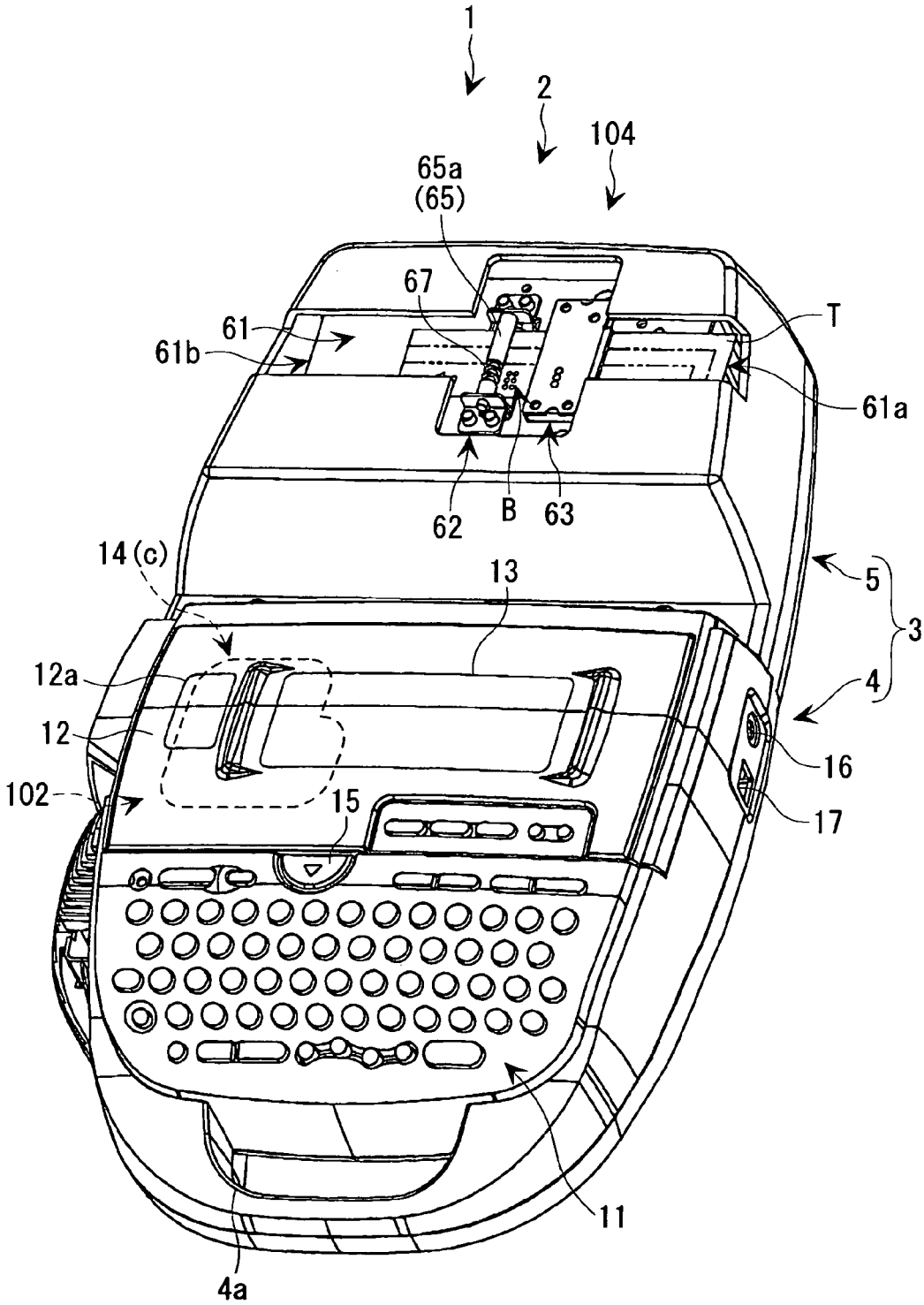
FIG. 2 is a perspective external view of a label forming apparatus with the lid closed.
Figure 3:
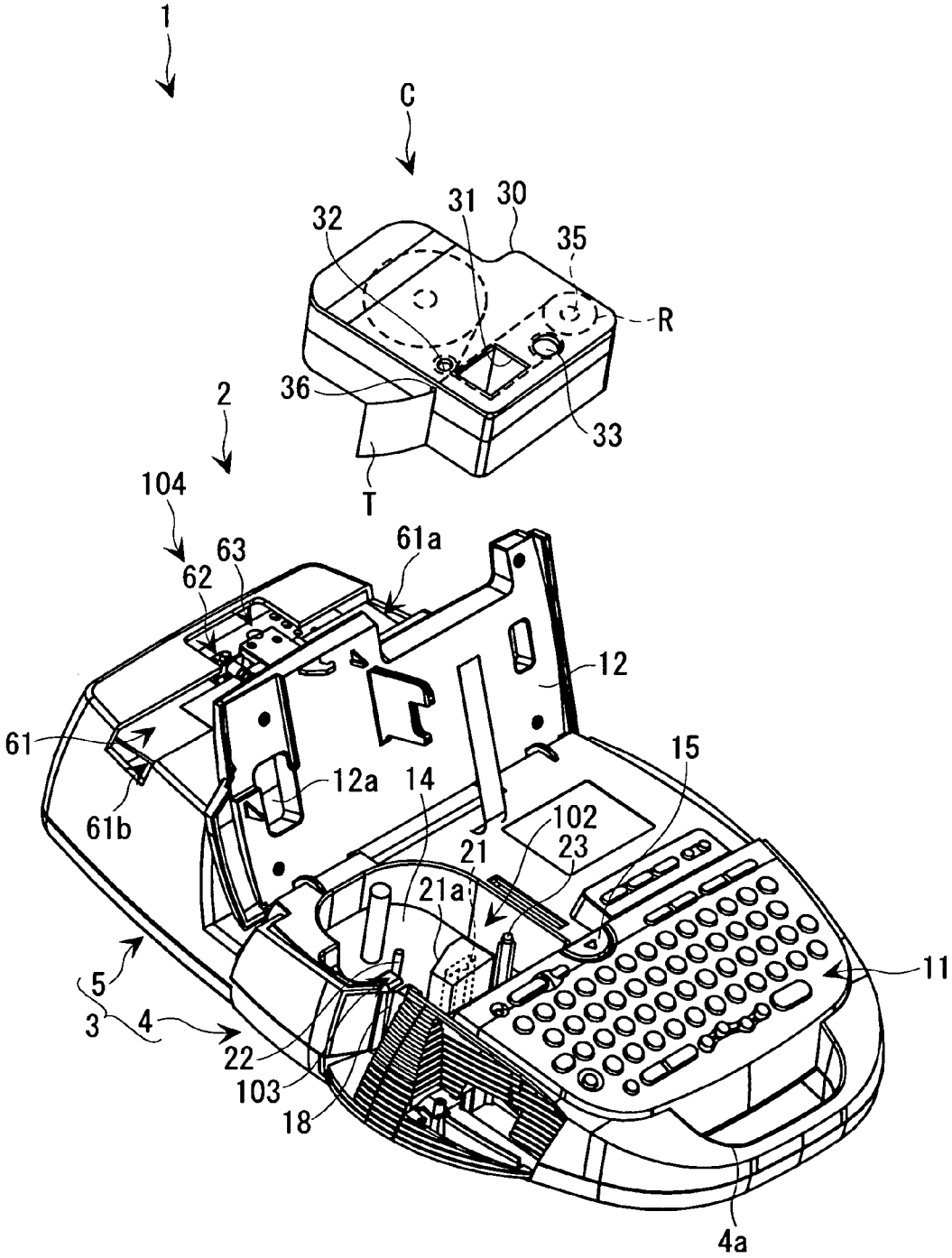
FIG. 3 is a perspective external view of the label forming apparatus with the lid left open.

FIG. 2 is an outside perspective view of the label forming apparatus 1 in a state in which a lid is closed. FIG. 3 is an outside perspective view of the label forming apparatus 1 in a state in which the lid is left open. The label forming apparatus 1 is made up of: an apparatus main body 2 which performs the printing operation and the embossing operation; and a tape cartridge C which houses therein a raised-letter tape T and an ink ribbon R and which is mounted or loaded on the apparatus main body 2.

The apparatus main body 2 has formed therein an outer shell by means of the apparatus casing 3. The apparatus casing 3 is made up of a front case 4, which has formed therein a handle 4*a*, and a rear case 5 which are integrally formed. The front case 4 has a written-letter printing section 102 and the rear case 5 has a raised-letter embossing section 104. The written-letter printing section 102 performs printing operation on a raised-letter tape T which is paid or fed out of the mounted tape cartridge C, and the raised-letter embossing section 104 performs embossing operation on the raised-letter tape T which is to be manually inserted by the user.

The front case 4 is provided, on its front upper face, with a keyboard 11 which has disposed therein various input keys and, on its rear upper face, with an open/close lid 12. The inner side of the open/close lid 12 is provided on the left side with a cartridge mounting section 14 for mounting the cartridge C in a recessed manner. The tape cartridge C is detachably mounted on the cartridge mounting section 14 in a state in which the open/close lid 12 is left open by the depression of a lid-open button 15. The open/close lid 12 has formed therein a peep hole 12*a* for visually recognizing the mounting and non-mounting (presence or absence) of the tape cartridge C with the open/close lid 12 closed.

On a right part of the front case 4, there are formed a power supply port 16 for supplying electric power, and a connection port (interface) 17 for connection with an outside apparatus such as a personal computer, or the like (not illustrated). It is thus so arranged that the written-letter printing and raised-letter embossing can be performed by connection to the outside apparatus based on the character information generated therein.

On a left part of the front case 4, there is formed a printing tape discharge port 18 which is communicated with the cartridge mounting part 14 and the outside. There is provided a tape cutter 103 in a manner to face this printing tape discharge port 18 so that the tape T fed out of the tape cartridge C can be cut. As a result of cutting the rear end of the raised-letter tape T with the tape cutter 103, the raised-letter tape T that has been printed with the written letters is discharged out of the printing tape discharge port 18.

The written-letter printing section 102 is made up of: a printing head 21 which is disposed in the cartridge mounting part 14, is provided with a thermal element, and is covered by a head cover 21*a*; a platen drive shaft 22 and a take-up drive shaft 23 for feeding the raised-letter tape T and the ink ribbon R of the tape cartridge C; a print-feeding motor 24 (see FIG. 5) for driving the platen drive shaft 22 and the take-up drive shaft 23; and a gear train, or the like.

In the corner of the cartridge mounting part 14, there is provided a tape recognition sensor 25 (see FIG. 5) which is constituted by a micro-switch.

The tape cartridge C contains the raised-letter tape T of a certain width and the ink ribbon R of the same width as the tape T in a rolled state, inside a cartridge casing 30 which is constructed to be dividable into upper and lower members. The cartridge casing 30 has disposed therein: a substantially square through hole 31 which vertically (i.e., in the axial direction of the take-up shaft 23 when mounted) penetrates through the cartridge casing 30; a platen roller 32; and a ribbon take-up reel 33, in a manner and position to correspond to the head cover 21*a*, the platen drive shaft 22, and the take-up drive shaft 23, respectively. A ribbon-feeding reel 35 is disposed close to the ribbon take-up reel 33. When the tape cartridge C is mounted on the cartridge mounting part 14, the printing head 21 is inserted into the square hole 31, and the platen drive shaft 22 and the take-up drive shaft 23 are respectively engaged with the platen roller 32 and the ribbon take-up reel 33. The printing head 21 thus comes into contact with the platen roller 32 with the raised-letter tape T and the ink ribbon R interposed therebetween, whereby the printing operation is ready to be performed.

The written-letter printing section 102 performs printing of the written letters with the printing head 21 based on the inputted character information, while feeding the raised-letter tape T by driving the platen roller 32. After having printed the written letters, only the raised-letter tape T is discharged out of a tape outlet 36 in the tape cartridge C, and the ink ribbon R is taken up inside the cartridge (i.e., by the ribbon take-up reel 33).

As the raised-letter tape T contained inside the tape cartridge C, there are prepared a plurality of kinds of different tape widths (12 mm, 18 mm, 24 mm, or the like). Although not illustrated, on the rear surface of the cartridge casing 30, there are formed a plurality of small holes which are used for recognition by the tape recognition sensor 25 of the kind of the raised-letter tape T.

For each of the tape widths, a plurality of kinds of raised-letter tapes T are available in different colors (white, red, blue, yellow, transparent, or the like).

Although not illustrated, the raised-letter tape T is provided with an adhesive-agent layer on the rear surface thereof and is made up of: a recording sheet which is made of a resin such as polyethylene terephtalate, or the like; and a peel-off (release) sheet which is adhered to the adhesive-agent layer and made of a resin such as polyethylene terephtalate, or the like. The release sheet is to facilitate the handling of the raised-letter tape T until its use and is also to protect the adhesive-agent layer from foreign matter such as dirt. The surface of the release sheet is subjected to silicone processing. Therefore, the adhesive force to be exerted by the adhesive-agent layer on the release sheet is extremely made smaller than the adhesive force to be exerted on the recording sheet. It is however so arranged that the adhesive-agent layer has the adhesive force to the release sheet enough to prevent the release sheet from getting peeled off during tape feeding operation in printing, during tape transporting for embossing operation, and during storing of the raised-letter tape T. The recording sheet has a thickness of about 60 μm, and the release sheet has a thickness of about 80 μm, and the total thickness of the raised-letter tape T is about 140 μm.

The cutting section 103 is disposed between the cartridge mounting part 14 and the printing tape discharge port 18 and is made up of: a full cutter 41 (see FIG. 5); and a half cutter 42 (see FIG. 5) which is disposed on a downstream side of the full cutter 41 as seen in the direction of the tape feeding. Although not illustrated, the full cutter 41 is a scissors-type of cutter having a movable blade and a stationary blade, and is designed to cut both (i.e., full-cut) the recording sheet and the release sheet of the raised-letter tape T by means of motor driving (with a full-cutter motor 43, FIG. 5). The half cutter 42 is a sliding type of cutter having a cutting blade and a receiving member to receive the cutting blade, and is designed to cut the recording sheet while leaving the release sheet of the raised-letter tape T (i.e., half-cut) by means of motor driving (with a half-cut motor 44, FIG. 5). With this half-cut portion serving as a clue, the release sheet can be easily peeled off.

The keyboard 11 has arranged therein character keys, power key for switching on and off the power source of the apparatus, and function key group which is used for designating various operation modes, or the like. The character key group is for performing printing operation and/or embossing operation, and has a full-key arrangement according to the layout of Japanese Industrial Standard (JIS). The function key group includes: execution key for executing printing operation and/or embossing operation; feeding-start key for commanding the starting of feeding of the raised-letter tape T in the raised-letter embossing section 104; selection key for data entry or scrolling at the time of text inputting, to command selection of various selection modes (to be described in detail hereinafter) on the selection screen, or the like. Aside from the above, the function key group includes, like in an ordinary word processor, a delete key for deleting the processing, a cursor key for moving the cursor, or the like.

The display 13 is capable of displaying display image data of 192 dots×80 dots inside a rectangle of about 12 cm long (X-axis direction)×about 5 cm wide (Y-axis direction). It is used by the user in inputting character information from the keyboard 11 to thereby prepare and edit the written-letter data for performing printing operation, and the raised-letter data for performing embossing operation, or to select various modes. Various errors or messages (contents of commands) are displayed to report to the user.

On the other hand, in the rear case 5, there is assembled the raised-letter embossing section 104 to perform embossing operation. The raised-letter embossing section 104 is made up of a tape travel passage 61, a tape feeding mechanism 62, and an embossing unit 63. The tape travel passage 61 is formed in a manner to cross the upper surface of the rear case 5 in the right-and-left direction (i.e., in the direction of tape traveling). The tape feeding mechanism 62 is positioned in an exposed manner in the upper center of the rear case 5 so that the raised-letter tape T manually fed from the embossing-tape inserting port 61*a* disposed in the right end of the tape travel passage 61 is fed toward the embossed tape discharge port 61*b* disposed in the left end of the tape travel passage 61. The embossing unit 63 is disposed on an upstream side of the tape feeding mechanism 62 (i.e., right side in the figure) so that the raised-letter tape T to be fed along the tape traveling path 61 is subjected to embossing operation.

The tape feeding mechanism 62 is made up of: a feeding roller 65 for feeding the raised-letter tape; and an emboss-feeding motor 66 (see FIG. 5) for rotating the feeding roller 65. The feeding roller 65 is constituted by a grip roller made up of a driving roller (not illustrated) and a driven roller 65*a* which are disposed in an up-and-down positional relationship. The driven roller 65*a* has three restricted portions 67 formed along the widthwise direction of the tape travel passage 61 (i.e., in the tape width direction) so that the embossed projections 202 formed on the raised-letter tape T do not get out of shape (or are not crushed).

Figure 4A:
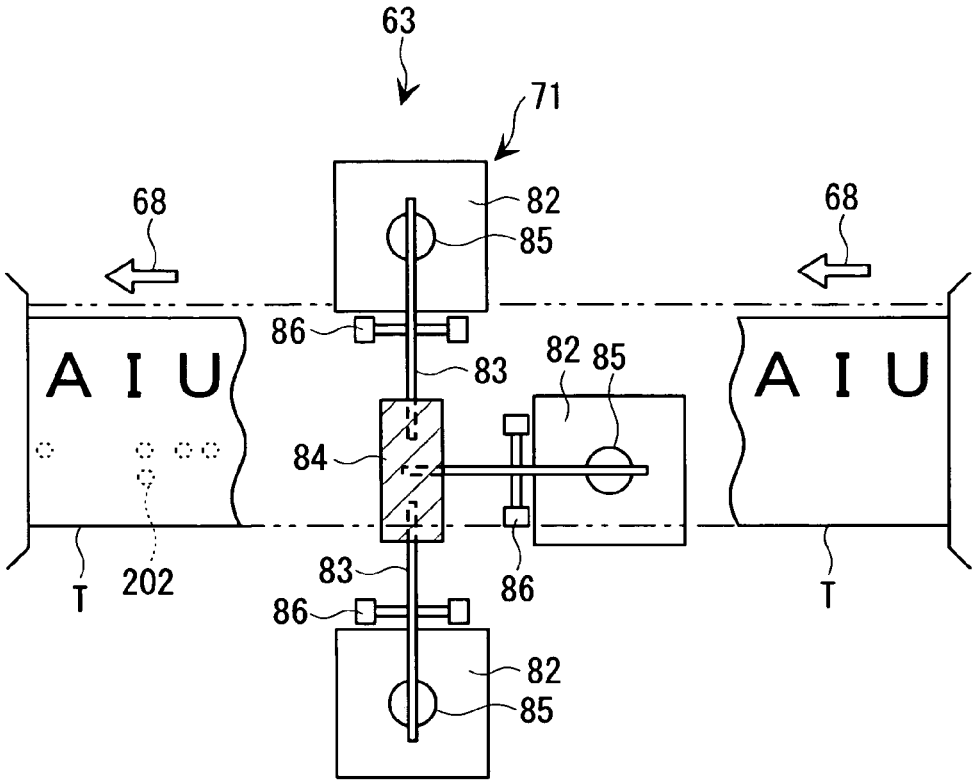
FIG. 4A is a plan view of an embossing unit and FIG. 4B is a side view, partially shown in section, thereof.
Figure 4B:
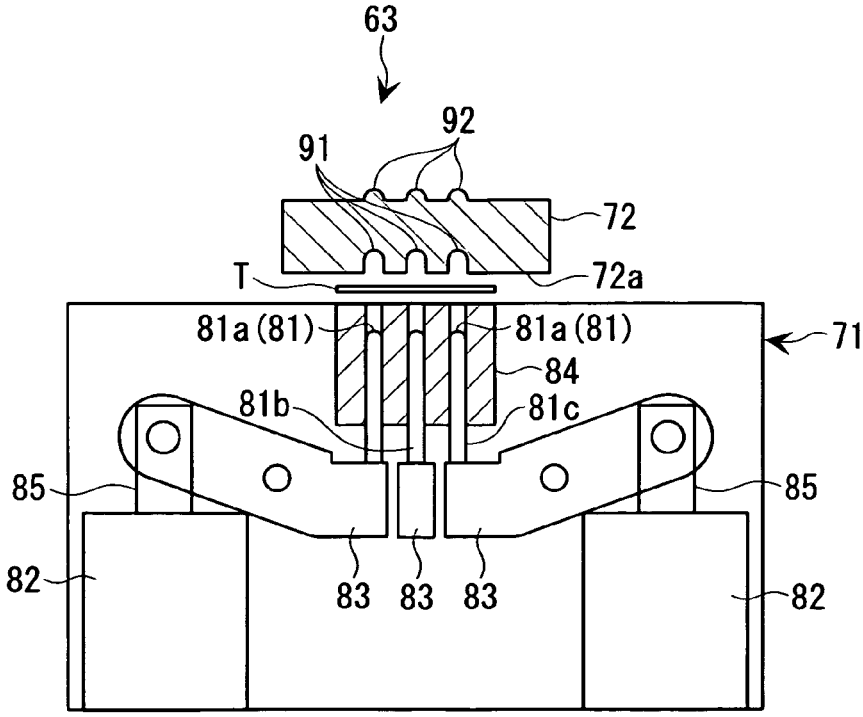

As shown in FIGS. 4A and 4B, the embossing unit 63 is made up of: an embossing head 71 having three embossing pins 81; and an emboss-receiving member 72 which has formed, on an embossed surface 72*a* facing the three embossing pins 81, three emboss-receiving recessions 91. The embossing pins 81 are selectively driven on the tape travel passage 61 from the rear side toward the raised-letter tape T which is introduced into the space between the embossing head 71 and the emboss-receiving member 72, whereby embossed projections 202 for the raised letters B are formed. In the figure, an arrow 68 denotes the direction in which the raised-letter tape T is fed by the tape feeding mechanism 62.

The embossing head 71 is made up of: three embossing pins 81; three solenoids 82; three arm members 83; and a guide member 84. The embossing pins 81 are arrayed at a pitch of about 2.4 mm to correspond to the vertical pitch Pa of the three vertical embossed projections 202 (first embossing pin 81*a*, second embossing pin 81*b*, third embossing pin 81*c* from the left in FIG. 4B). The solenoids 82 serve as the driving source of each of the embossing pins 81. The arm members 83 connect the three embossing pins 81 to the three solenoids 82 respectively. The guide member 84 serves to vertically hold the three embossing pins 81 relative to the embossed surface 72*a* of the emboss-receiving member 72 and to guide the linear movement of each of the embossing pins 81. The first embossing pin 81*a*, the second embossing pin 81*b* and the third embossing pin 81*c* respectively correspond to the first-stage embossing points 201*a*, 201*d*, the second-stage embossing points 201*b*, 201*e* and the third-stage embossing points 201*c*, 201*f* (see FIG. 1).

The embossing head 71 is located relative to the raised-letter tape T to be fed along the tape feeding path 61 so as to perpendicularly face the lower end of the tape T as seen in the tape-feeding direction.

Each of the embossing pins 81 is made of stainless steel, or the like, and its head portion is formed into hemisphere. Each of the arm members 83 is connected, in a semi-fixed or partly fixed manner, at its one end to the rear portion of the relevant embossing pin 81 and, at the opposite end thereof, to a front end portion of a plunger 85 of a solenoid 82 in a rotatable manner. In an intermediate portion of the arm member 83, there is provided a supporting member 86 to facilitate the rotating movement thereof. The plunger 85 of the solenoid 82 and the embossing pin 81 are disposed in parallel with each other. Therefore, when the plunger 85 moves forward with the energizing of the solenoid 82, or when the plunger 85 moves back by a spring (not illustrated) with the de-energizing of the solenoid 82, the arm member 83 rotates with the supporting member 86 serving as the center of rotation. As a result, the embossing pin 81 performs a linear movement (embossing) in a vertical (or perpendicular) direction to the raised-letter tape T. The charging voltage to the solenoid 82 is set to be a value (e.g., 18V) which attains an appropriate height (about 0.4 mm) of the embossed projection 202.

The mounting position of each of the solenoids 82 and the mounting position of each of the supporting members 86 are made to be adjustable within a given range in the longitudinal direction of each of the arm members 83, whereby the operating stroke of the embossing pins 81 is adjustable. By thus adjusting the operating stroke of the embossing pins depending on the material, thickness, or the like, of the raised-letter tape T to be used, the height of the embossed projection 202 can be adjusted.

The emboss-receiving member 72 is intended to receive the embossing movement of the embossing pins 81 onto the raised-letter tape T, and is manufactured by metal pressing of a material such as aluminum. The surface 72*a* which faces the three embossing pins 81 and which is subjected to the embossing operation has three emboss-receiving recessions 91 which correspond to the three embossing pins 81. Each of the emboss-receiving recessions 91 is formed substantially into a shape (hemisphere) which is complementary with the head portion of the embossing pin 81. On the rear surface of the emboss-receiving member 72, there are formed three hemispherical projections 92 to correspond to the three emboss-receiving recessions 91.

When the raised-letter tape T is fed with the emboss-feeding motor 66 serving as the driving source, and the solenoid 82 is driven in a manner to synchronize with the raised-letter data from the control section 107 which is described in detail hereinafter, the embossing pins 81 operate to emboss from the rear side to the raised-letter tape T which is introduced into the space between the embossing head 71 and the emboss-receiving member 72, whereby the embossed projections 202 are formed on the surface of the raised-letter tape T. In other words, the embossing operation of the raised letters is performed by the cooperation of the embossing unit 63, the tape feeding mechanism 62, and the control section 107 which controls the drive of the above.

Figure 5:
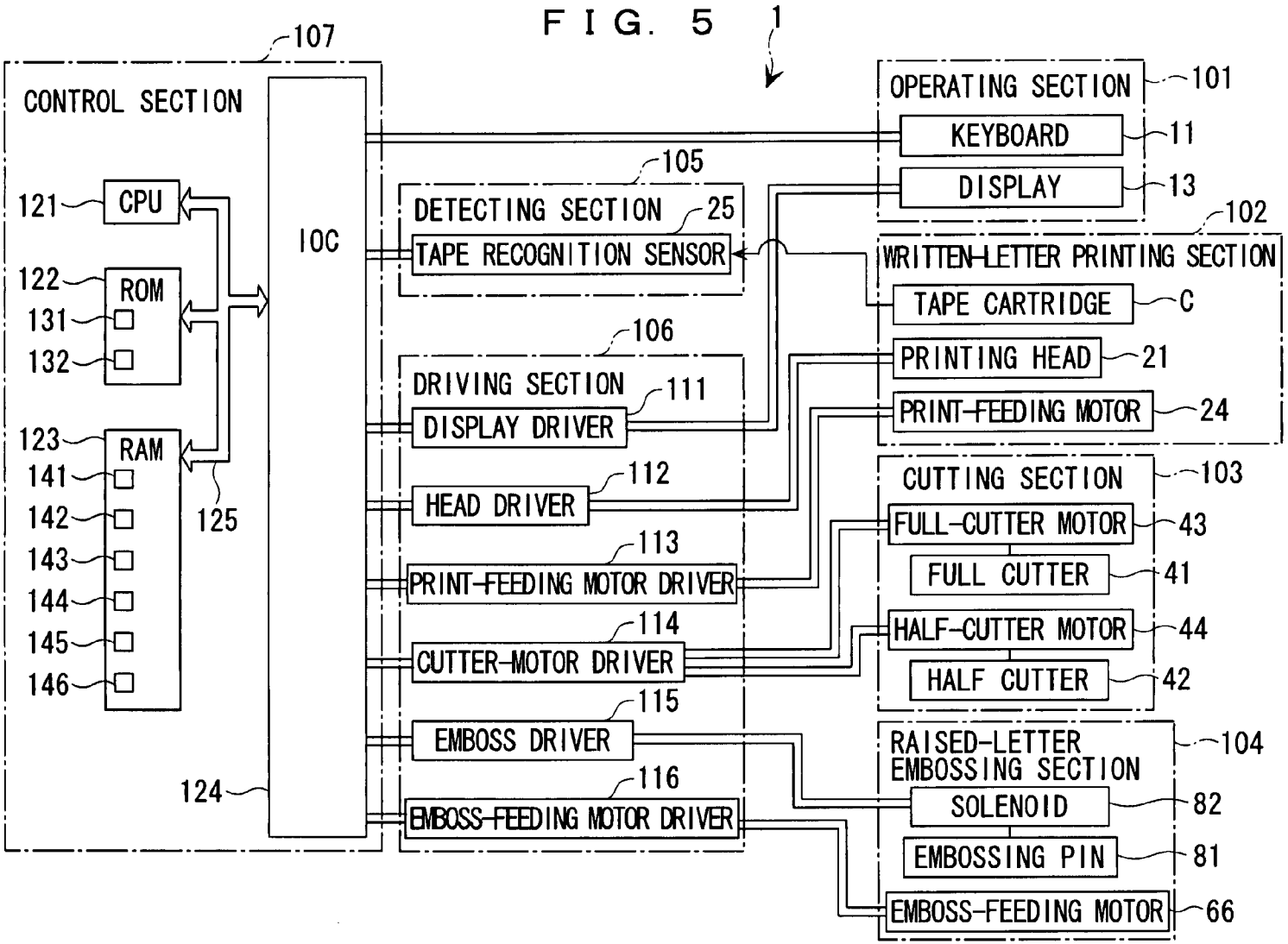
FIG. 5 is a block diagram of the label forming apparatus.
Figure 6A:
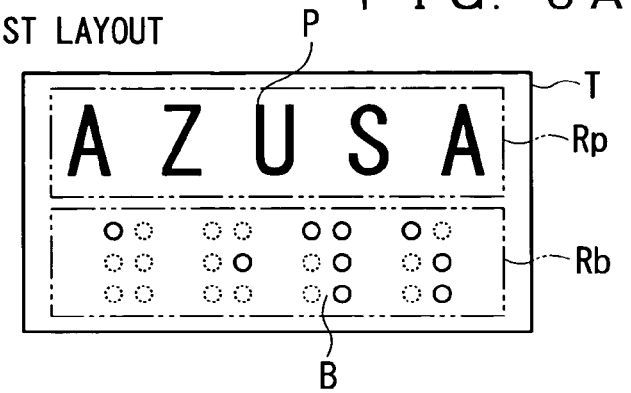
FIGS. 6A through 6E are schematic views showing the layout of a written-letter printing region and a raised-letter embossing region.
Figure 6B:
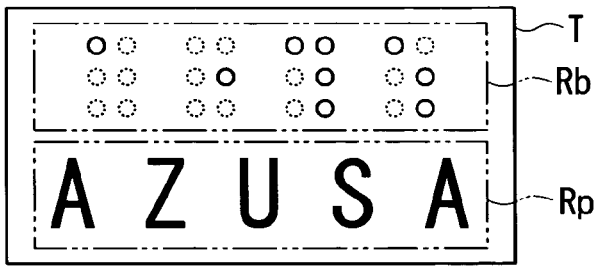
Figure 6C:
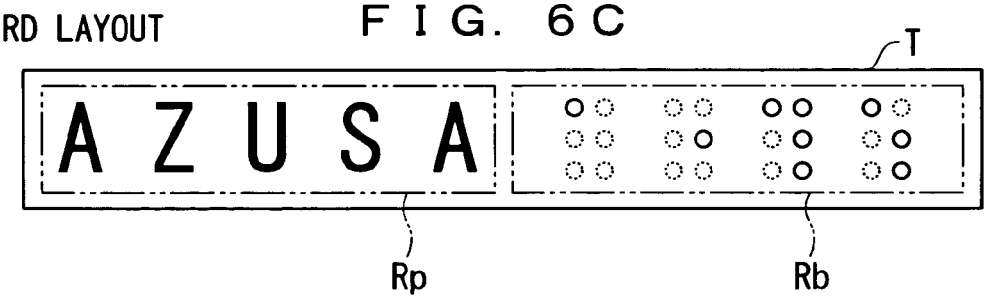
Figure 6D:
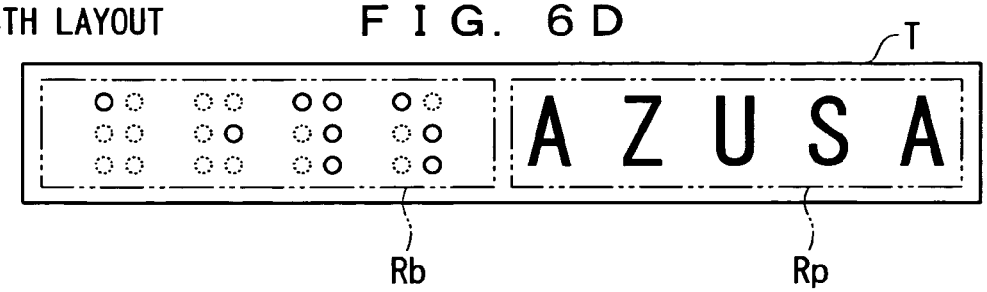
Figure 6E:
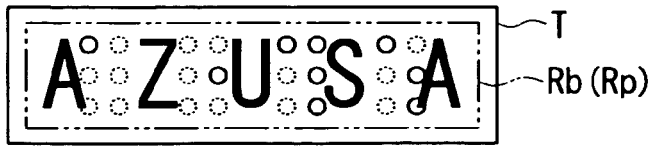

With reference to FIG. 5, a description will now be made about the control system of the label forming apparatus 1. The label forming apparatus 1 is made up of: an operating section 101 which has the keyboard 11 and the display 13 and controls the user interface such as the inputting of the character information by the user and the displaying of the various kinds of information; the written-letter printing section 102 which has the tape cartridge C, the printing head 21, and the print-feeding motor 24, and which performs raised-letter embossing on the raised-letter tape T while feeding the raised-letter tape T and the ink ribbon R; the cutting section 103 which has the full cutter 41, half cutter 42, and the full-cutter motor 43 and the half-cuter motor 44 which respectively drive the above and which perform full cutting and half cutting on the printed raised-letter tape T; the raised-letter embossing section 104 which has the solenoids 82, the embossing pins 81, and the emboss-feeding motor 66 and which performs raised-letter embossing on the raised-letter tape T while feeding it; a detecting section 105 which has various sensors such as a tape recognition sensor 25 for detecting the kind of the raised-letter tape T (tape cartridge C), and which performs various detections; a driving section 106 which has a display driver 111, a head driver 112, a print-feeding motor driver 113, a cutter-motor driver 114, an embossing driver 115, and emboss-feeding motor driver 116 which drives each of the above; and the control section 107 which is connected to each of the above sections and which controls the entire label forming apparatus 1.

The control section 107 is provided with a CPU 121, a ROM 122, a RAM 123 and an input/output controller (IOC) 124 which are connected to one another by an internal bus 125. The ROM 122 is provided with: a control program block 131 which stores therein a control program for controlling the various processing such as the written-letter print processing, the raised-letter print processing, or the like, by means of the CPU 121; and a control data block 132 which stores therein emboss-inspection data of plural kinds of emboss-inspection patterns, control data for emboss-control of the raised-letter data, aside from the character font data for performing the printing operation and the raised-letter font data for performing the embossing operation.

The RAM 123 is provided, aside from a various work area block 141 to be used as flags, or the like, with: a written-letter print-data block 142 which stores therein the generated written-letter data; a raised-letter embossing data block 143 which stores therein the generated raised-letter embossing data; a display data block 144 which stores therein display data for displaying on the display 13; an emboss-inspection pattern data block 145 which stores therein emboss-inspection data for the selected emboss-inspection pattern; and a layout data block 146 which stores therein layout data relating to the layout setting of a written-letter printing region Rp and a raised-letter embossing region Rb which are described in more detail hereinafter. The RAM 123 is constantly backed up so as to keep the stored memory even in case of power failure.

The IOC 124 has assembled therein a logic circuit which supplements the function of the CPU 121 and handles interface signals with various kinds of peripheral circuits in the form of gate arrays, custom-made LSIs, or the like. According to this arrangement, the IOC 124 captures input data and control data from the keyboard 11 as they are or with processing into the internal bus 125, and also outputs the signals outputted from the CPU 121 into the internal bus 125 as they are or with processing into the driving section 106.

According to the above arrangement, the CPU 121 inputs various signals/data from each part of the label forming apparatus 1 through the IOC 124 based on the control program inside the ROM 122. Based on the inputted various signals/data, various data inside the RAM 123 is processed and output the various signals/data into each part of the label forming apparatus 1 through the IOC 124, thereby performing the written-letter print-processing and raised-letter emboss-processing.

As an example, in case the printing operation and the embossing operation are performed based on the inputted character information, the CPU 121, once the character information is inputted from the keyboard 11, or the like, generates the written-letter print information based thereon and temporarily stores it in the written-letter print-data block 142. The CPU 121 also generates the raised-letter embossing data block 143 similarly based on the character information and temporarily stores it in the raised-letter embossing data block 143. Once the commands for printing operation and the embossing operation are obtained (i.e., an input is made to the entry key) from the keyboard 11, the driving of the print-feeding motor 24 is started and the printing head 21 is driven, whereby the printing operation based on the written-letter data (character information) inside the written-letter print-data block 142 is performed. Further, tape feeding by the predetermined length based on the written-letter print data is performed and half cutting is performed by the half cutter 42. Thereafter by cutting the rear end of the tape with the full cutter 41, the raised-letter tape T is discharged out of the printing tape discharging port 18.

Subsequently, in the absence of the reset operation and the power off operation, the user manually inserts the raised-letter tape T which has been cut into a rectangular shape, into the embossed tape inserting port 61*a*. When the feed start key is subsequently depressed, the embossing unit 63 and the tape feed mechanism 62 are driven and the embossing operation is performed based on the raised-letter embossing data (character information) inside the raised-letter embossing data block 143. After the embossing has been finished, the tape is fed by a predetermined length based on the raised-letter embossing data by the operation of the emboss-feeding motor 66. The raised-letter tape T is thus discharged out of the raised-letter tape discharge outlet 61*b*.

Although the details are given hereinafter, in case the printing operation and the embossing operation are performed based on the emboss-inspection pattern, the CPU 121 generates the written-letter printing data of a print-inspection pattern that is the same as the predetermined emboss-inspection pattern, and then temporarily stores it in the written-letter print-data block 142. Then, based on the emboss-inspection pattern, the raised-letter embossing data are generated and temporarily stores it in the raised-letter data block 143. In the same manner as above, the printing operation is performed based on the written-letter printing data (print-inspection pattern) inside the written-letter print-data block 142 and, subsequently, embossing operation is performed based on the raised-letter embossing data (emboss-inspection pattern) inside the raised-letter embossing data block 143.

As described above, the label forming apparatus 1 is capable of performing both the printing operation and the embossing operation. In the embossing operation, raised letters B can be embossed based on the inputted character information, and embossing can be performed based on the predetermined emboss-inspection pattern. Therefore, by the selection key of the keyboard 11, the user can select and make setting, while looking at the display 13, to either the print-/emboss-processing mode in which printing operation and/or embossing operation is performed based on the inputted character information and the raised-letter embossing in which the embossing operation is performed based on the emboss-inspection pattern.

The print-/emboss-processing mode includes: a first processing mode for performing the printing operation and the embossing operation based on the inputted character information; a second processing mode for performing only the embossing operation based on the inputted character information; and a third processing mode for performing only the printing operation based on the inputted character information. The user can select one of the above three modes.

As shown in FIGS. 6A-6E, when the first processing mode is selected, the user can set the following positions, i.e.,: the position of the written-letter printing region Rp in which the printing operation is performed on the raised-letter tape T to thereby print the written letters P; and the position of the raised-letter embossing region Rb in which the embossing operation is performed to thereby emboss the raised letters B. In other words, by selecting one out of the plurality of predetermined layouts with the selection key, the layout of the written-letter printing region Rp and the raised-letter embossing region Rb can be set. FIGS. 6A-6E have Japanese term transliterated into alphabets "AZUSA" which happens to be a nickname of a Japanese express railway train. The raised letters are those which correspond to the Japanese term and not to the alphabets.

As the layout of the written-letter printing region Rp on the raised-letter tape T, there are the following, i.e., a first layout in which the written-letter printing region Rp is on the upper stage and the raised-letter embossing region is on the lower stage; a second layout in which written-letter printing region Rp is on the lower stage and the raised-letter embossing region is on the upper stage; a third layout in which the written-letter printing region Rp is on the left side and the raised-letter embossing region is on the right side; a fourth layout in which the written-letter printing region Rp is on the right side and the raised-letter embossing region is on the left side; and a fifth layout in which the written-letter printing region Rp and the raised-letter embossing region Rb are in the same position. In case the inspection result of the tape width is 24 mm, one of the above will be selected. In case the inspection result of the tape width is 18 mm, one of the first layout and the fifth layout is selected. In this case, the length of the written-letter printing region Rp in the direction of the tape width is shortened according to the tape width. In case the inspection result of the tape width is 12 mm, the written-letter printing region Rp and the raised-letter embossing region Rb cannot be laid out on the upper and lower positional relationship. Therefore, one of the third through fifth layouts will have to be selected.

As described above, the label forming apparatus 1 according to this embodiment has an arrangement in which the raised-letter embossing is performed on the lower end (as seen in the figure) of the raised-letter tape T which is being fed. Therefore, when the setting is made to the second layout, the raised-letter tape T must be manually inserted upside down into the embossed-tape inserting port 61*a*. Of course, there may be employed an arrangement in which the embossing head 71 is movable in a direction perpendicular to the tape feeding direction so that the written-letter printing region Rp and the raised-letter embossing region Rb can be allocated in the up-and-down positional relationship.

On the other hand, the emboss-inspection mode is to perform embossing operation on the raised-letter tape T based on the emboss-inspection pattern which is made up of a repetition of a predetermined bit pattern. The emboss-inspection mode is made up of: a first inspection mode in which embossing operation is performed based on a predetermined emboss-inspection pattern and also printing operation is performed based on a print-inspection pattern that is the same as the emboss-inspection pattern; and a second inspection mode in which only embossing operation is performed based on a predetermined emboss-inspection pattern. The user selects one of the inspection modes.

Aside from the selection of the inspection mode, the user also selects by the selection key an arbitrary emboss-inspection pattern out of the above-described plural (four) kinds of emboss-inspection patterns stored in the control data block 132.

As shown in FIGS. 7*a*-7D, embossing is performed based on the selected emboss-inspection pattern, whereby an emboss-inspection pattern CHb is embossed on the raised-letter tape T. In case the first inspection mode is selected, the print-inspection pattern CHp is further printed based on the print-inspection pattern.

Figure 7A:
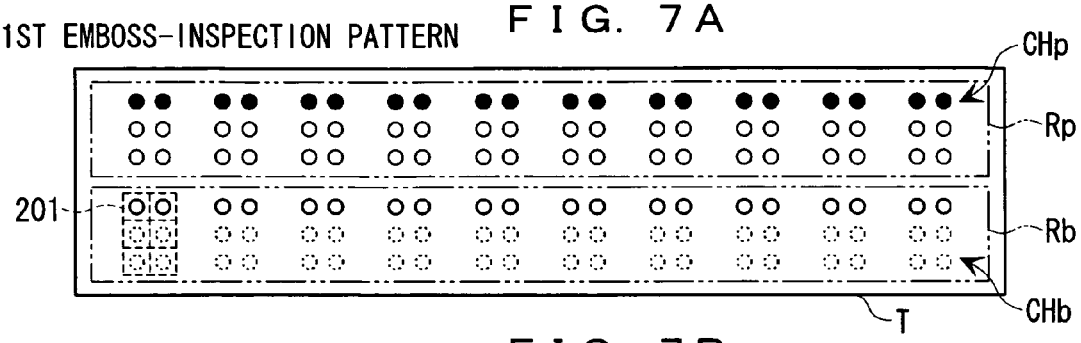
FIGS. 7A through 7D are schematic views showing four kinds of emboss-inspection patterns and FIG. 7E is a schematic view showing a selection screen of the four kinds of emboss-inspection patterns.
Figure 7B:
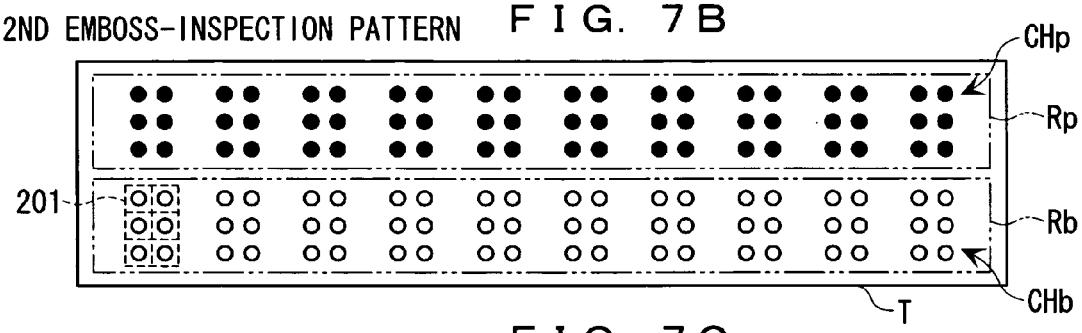
Figure 7C:
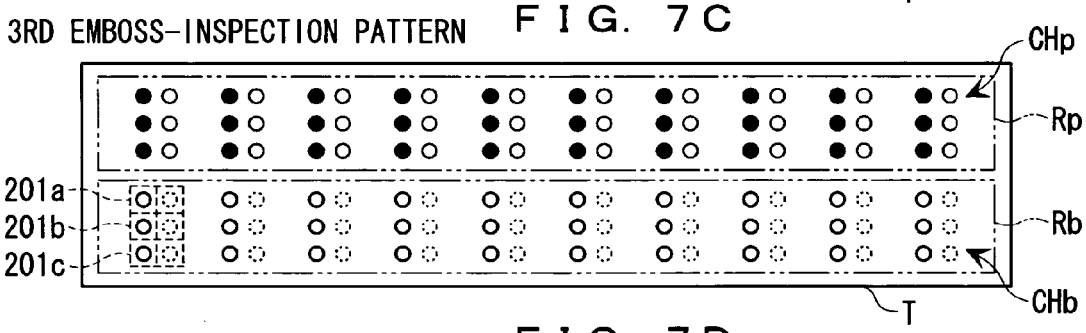
Figure 7D:
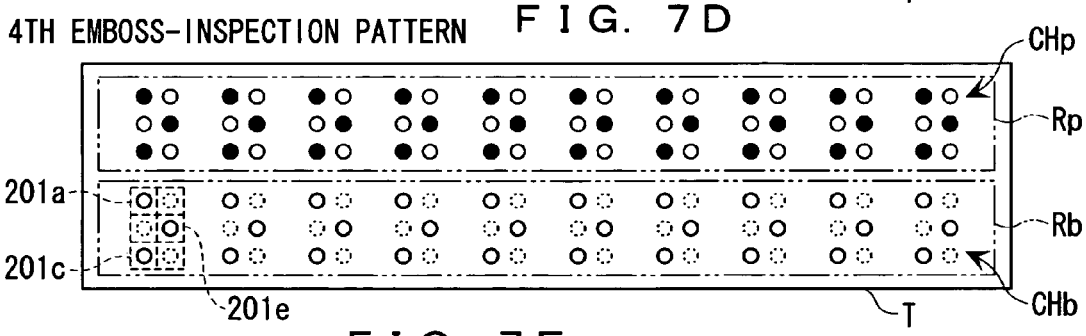
Figure 7E:
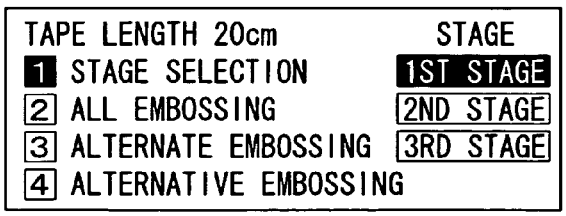

The emboss-inspection pattern is made up of: a first emboss-inspection pattern which is a repetition of a bit pattern to be embossed on an arbitrary stage of each row among the embossing points 201 (stage selection; see FIG. 7A); a second emboss-inspection pattern which is a repetition of a bit pattern to be embossed on all of the embossing points 201 (all embossing; see FIG. 7B); a third emboss-inspection pattern which is a repetition of a bit pattern to be embossed on all embossing points 201*a*-201*c* on the first row out of the embossing points 201 (alternate or alternate-row embossing; see FIG. 7C); and a fourth emboss-inspection pattern which is a repetition of a bit pattern to be embossed on the embossing points 201*a*, 201*c* of the first stage and the third stage on the first row and also on the embossing point 201*e* of the second stage on the second row (alternative embossing; see FIG. 7D). In case the first emboss-inspection pattern is selected, those embossing points 201 on an arbitrary stage which are to be embossed is selected by the selection key (see FIG. 7E).

In the illustrated example, the number of times of repetition of the bit pattern in each of the emboss-inspection patterns is set to be ten. This number of repetition is, however, arbitrary; whenever the user selects the emboss-inspection mode, the number of repetition shall preferably be altered.

Also in the emboss-inspection mode, in case the first inspection mode is selected, it is possible to set the layout of the written-letter printing region Rp and the raised-letter embossing region Rb on the raised-letter tape T. The layout can be selected out of the first layout through the fifth layout. FIGS. 7A-7D show the printing and embossed result when the first layout is selected.

Figure 8:
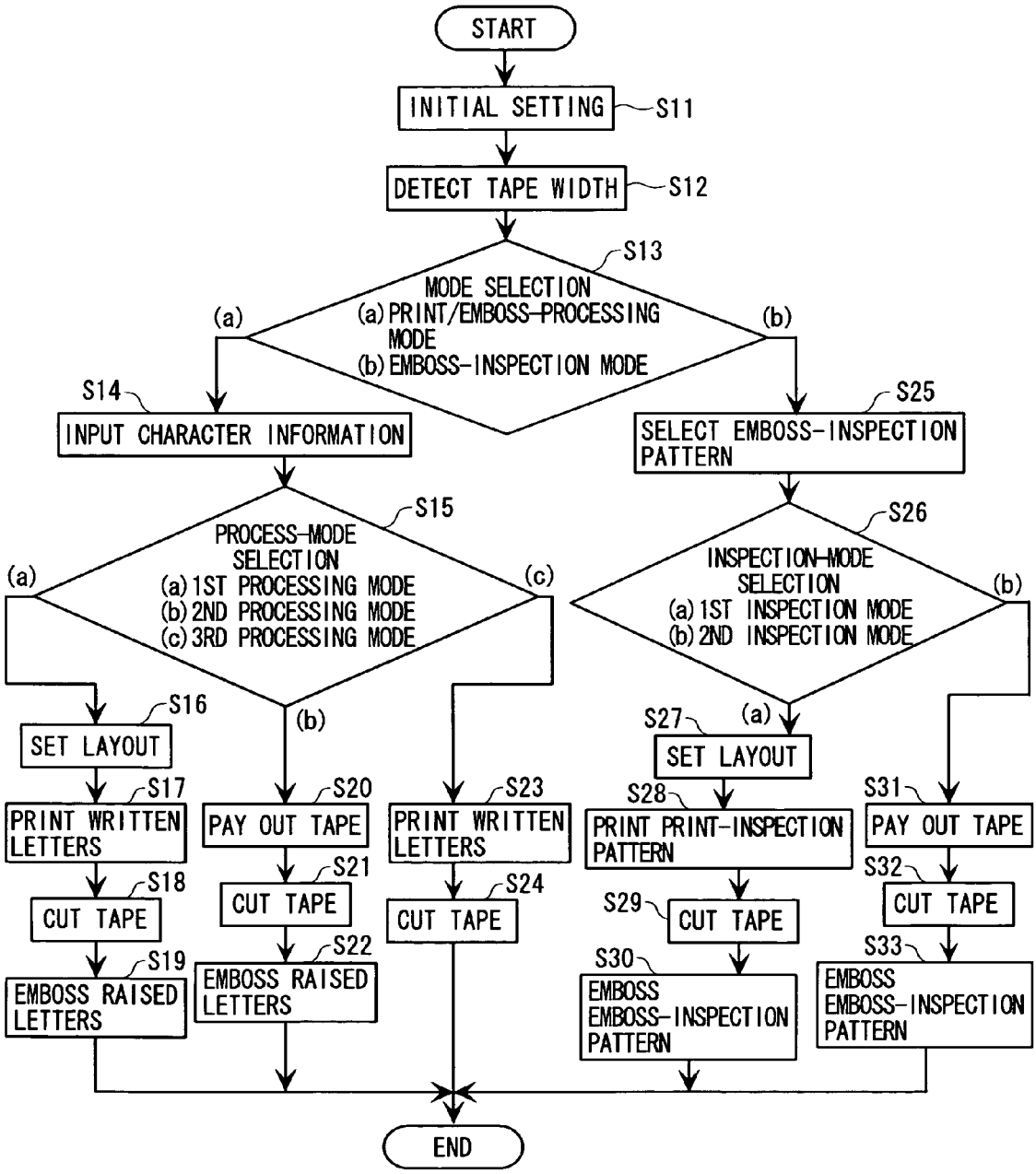
FIG. 8 is a flow chart showing an overall processing of the label forming apparatus.

FIG. 8 shows an entire processing of the label forming apparatus 1. When the processing is started by depressing the power key (Power ON), an initial setting is made (S11) by restoring various saved control flags, or the like, to thereby return the state back to the one at the time of switching off, and also detects the tape kind (tape width) by the tape sensor 25 (S12). Then, the user selects one of the print-/emboss-processing mode and the emboss-inspection mode (S13).

In case the print-/emboss-processing mode is selected (S13, (a)), the character information is inputted by the user in the form of data input from the keyboard 11 or from an outside apparatus (S14). The processing mode is thus selected (first processing mode, second processing mode, third processing mode; S15).

In case the first processing mode is selected (S15, (a)), setting is made (S16) of the layout of the written-letter printing region Rp and the raised-letter embossing region Rb on the raised-letter tape T based on the result of the tape width detection (S12). Then, the written letters P are printed (S17) on the written-letter printing section 102 of the raised-letter tape T fed from the mounted tape cartridge C. The raised-letter tape T is then cut by the cutting section (S18), and the raised letter tape T inserted into the embossed tape inserting port 61*a* is subjected to the embossing operation (Sl9). The processing is then finished.

In case the second processing mode is selected (S15, (b)), the raised-letter tape having the length required for the embossing operation is drawn (or paid) out of the mounted tape cartridge C (S20), and the raised-letter tape T is then cut by the cutting section (S21). Thereafter, the raised-letter tape T manually inserted into the tape inserting port 61*a* (S22) is subjected to embossing operation, thereby finishing the processing. In case the third processing mode is selected (S15, (c)), the raised-letter tape T rolled out of the mounted tape cartridge C is subjected to printing of the written letters P by the written-letter printing section 102 (S23), and the raised-letter tape T is cut by the cutting section (S24), thereby finishing the processing.

On the other hand, in case the emboss-inspection mode is selected after switching on the power (S13, (b)), selection is made by the user of the emboss-inspection pattern (S25) and then of the inspection mode (first inspection mode, second inspection mode; S26).

In case the first inspection mode is selected (S26, (a)), setting of the layout is made (S27). Then, the raised-letter tape T paid out of the mounted tape cartridge C is subjected to the printing of the print-inspection pattern (print-inspection pattern CHp) by the written-letter printing section 102 (S28). The raised-letter tape T is cut by the cutting section (S29). Thereafter, the raised-letter tape T manually inserted into the embossed tape inserting port 61*a* is subjected to embossing of the emboss-inspection pattern (emboss-inspection pattern CHb) by the raised-letter embossing section 104 (S30), thereby finishing the processing. According to the above arrangement, the printing operation is performed based on the print-inspection pattern that is the same as the emboss-inspection pattern. As a result, the raised-letter tape T is embossed with the emboss-inspection pattern CHb and is also printed with the print-inspection pattern CHp that is the same therewith (see FIGS. 7A-7D). Therefore, by comparing the embossed emboss-inspection pattern CHb and the printed print-inspection pattern CHp, it can be easily judged as to whether the embossing operation has been accurately performed based on the predetermined emboss-inspection pattern or not. Further, since it is possible to set the layout of the raised-letter embossing region Rb and the written-letter printing region Rp, the raised-letter embossing region Rb and the written-letter printing region Rp can be disposed at arbitrary positions such as up and down, right and left, at the same position, or the like, in order to facilitate the comparison between the embossed emboss-inspection pattern CHb and the printed print-inspection pattern CHp.

In case the second inspection mode is selected (S26 (b)), the raised-letter tape of the length required for the emboss-inspection is paid out of the mounted tape cartridge C (S31) and, without performing the printing of the print-inspection pattern CHp, the raised-letter tape T is cut by the cutting section (S32). Thereafter, the raised-letter tape T manually inserted into the embossed tape inserting port 61*a* is subjected to the embossing of the emboss-inspection pattern by the raised-letter embossing section 104 (S33), thereby finishing the processing. In this manner, only the emboss-inspection pattern CHb may be embossed without printing the print-inspection pattern CHp on the raised-letter tape T. According to this arrangement, the ink ribbon R can be saved.

As described above, in the emboss-inspection mode, the embossing operation is performed on the raised-letter tape T based on the emboss-inspection pattern which is a repetition of a predetermined bit pattern. Therefore, based on the result of embossing (embossed inspection pattern CHb) such as continuous failure of embossing, gradual decrease in the embossed height, positional deviation in the embossed projection, or the like, it can be easily identified as to which of the portions relating to the embossing operation, i.e., the embossing unit 63, the tape feeding mechanism 62, and the control section 107 to control the drive thereof, has the cause for the trouble.

Now, with reference to FIGS. 9-12A and 12B, a description will now be made about the result of embossing based on the above-described four kinds of emboss-inspection patterns and the possible portions of troubles estimated from the result of embossing. As shown in FIG. 9, the first emboss-inspection pattern is the one in which, as described above, the bit pattern is made by embossing on an arbitrary stage of each row, i.e., the arbitrary embossing is caused to perform embossing repeatedly without rest. In other words, the solenoid 82 is repeatedly subjected to the charging of a predetermined voltage, resulting in a large operating cycle of the solenoid 82. Therefore, in case there is a problem in that the temperature of the coil in the solenoid 82 rises excessively, the following embossed result will be obtained. Namely, if the embossing operation is performed based on the first emboss-inspection pattern, the mechanical output of the solenoid 82 gradually decreases by the rise in the coil temperature accompanied by the repetition of the embossing operation. The size of forward and backward (or up and down) movement of the embossing pin 81 thus gradually decreases, and the height of the embossed projection 202 becomes gradually smaller (gradual decrease in embossed height; see FIG. 9B). In this manner, by performing the embossing operation based on the first emboss-inspection pattern, an identification can be easily made that the trouble lies in the embossing unit 63 (solenoid 82).

Figure 9A:
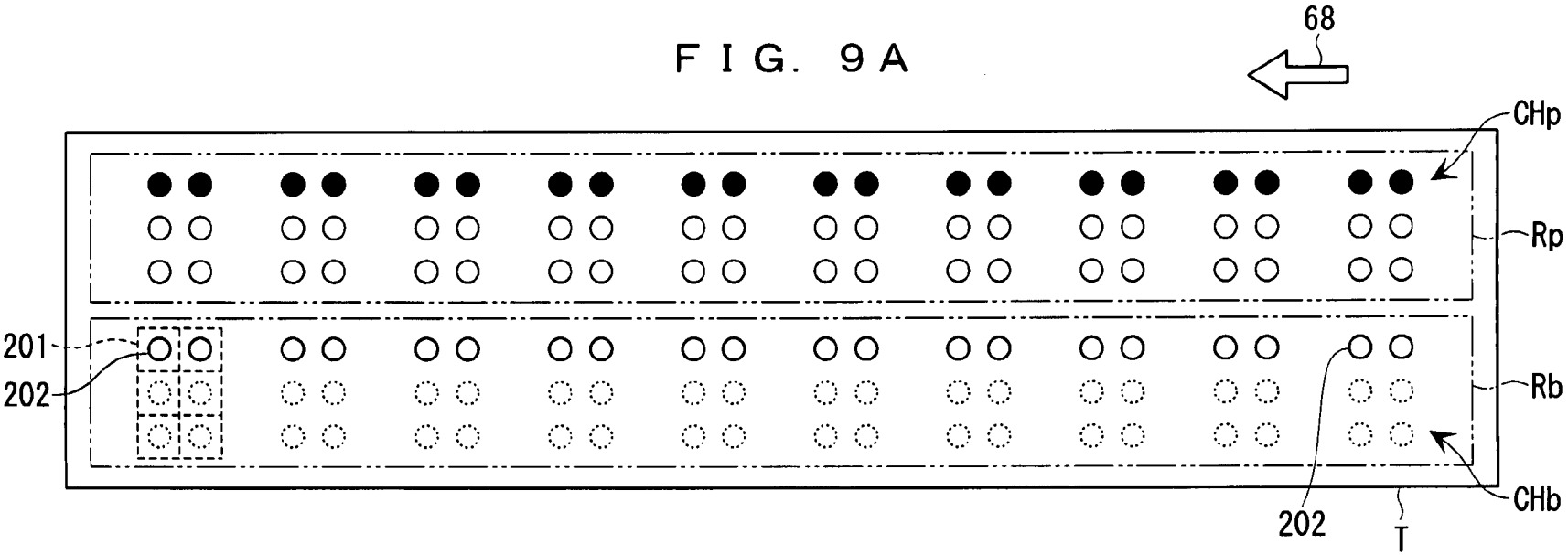
FIG. 9A is a schematic plan view of an embossed result according to a first emboss-inspection pattern and FIG. 9B is a side view thereof.
Figure 9B:
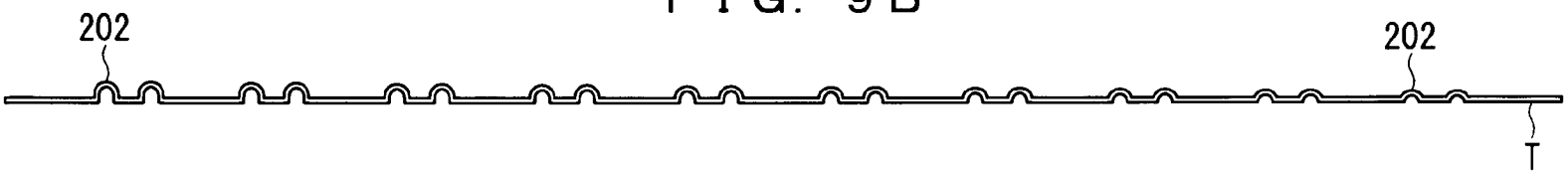

The arrow 68 in FIG. 9A designates the direction of tape feeding. It follows that the embossing on the raised-letter tape T in the figure is performed from the left to the right as seen in the figure.

Figure 10:
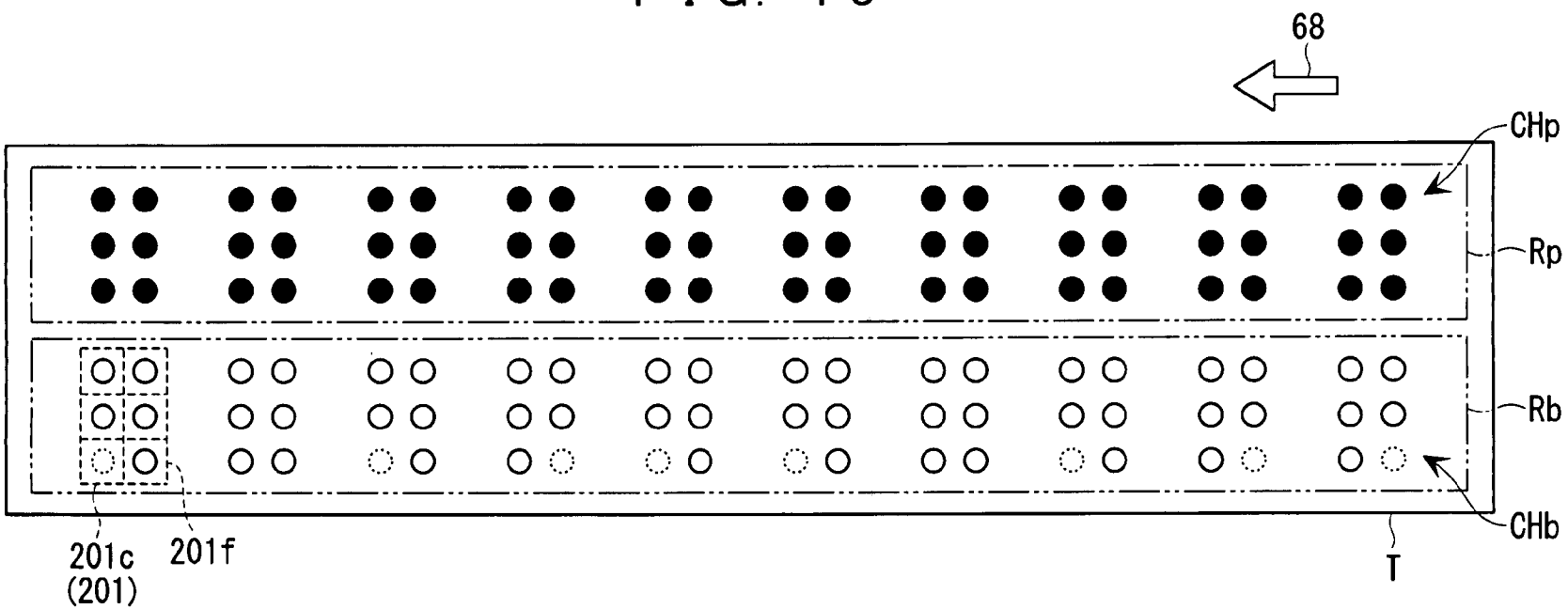
FIG. 10 is a schematic plan view of an embossed result according to a second emboss-inspection pattern.

As shown in FIG. 10, the second emboss-inspection pattern has a bit pattern to emboss all of the embossing points 201 and, therefore, embossing by the embossing pins 81 is performed all at the same time, and each of the embossing pins 81 is repeatedly caused to emboss without rest. Therefore, if there is a problem in the signal system to control the driving of the third embossing pin 81*c*, or in the embossing mechanism for the third embossing pin 81*c*, for example, there can be obtained the following embossed result. Namely, when the embossing operation is performed based on the second emboss-inspection pattern, while the embossing by the first embossing pin 81*a* and the embossing by the second embossing pin 81*b* may properly be performed, only the embossing by the third embossing pin 81*c* is not properly performed. As a result, part or all of the embossing points 201*c*, 2001*f* cannot be embossed (continuous failure in embossing; emboss-inspection pattern CHb). In this manner, by performing the embossing operation by the second emboss-inspection pattern, it can be easily identified that the problem lies in the control section 107 or in the embossing unit 63 (particularly the embossing mechanism). Like the first emboss-inspection pattern, the second emboss-inspection pattern is effective in identifying the problem in the embossing unit 63 (particularly the solenoid 82).

Figure 11:
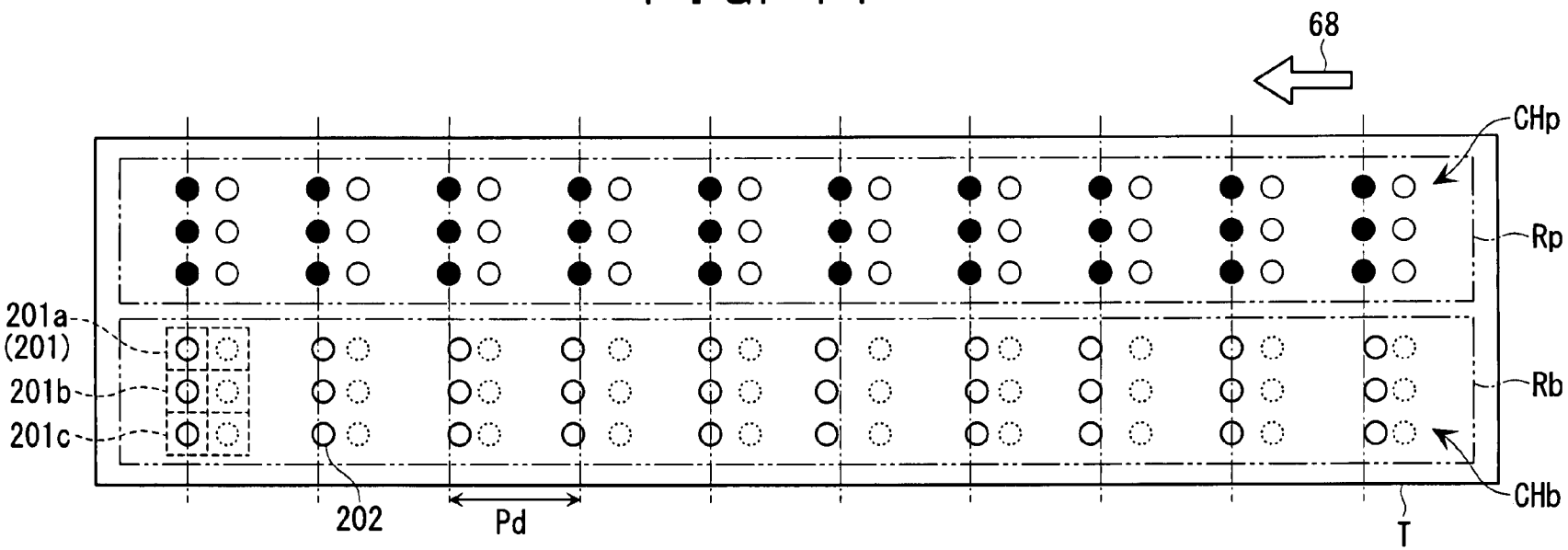
FIG. 11 is a schematic plan view of an embossed result according to a third emboss-inspection pattern.

As shown in FIG. 11, the third emboss-inspection pattern has a bit pattern to cause all of the embossing points 201*a*-201*c* of the first row, out of the embossing points 201, to be embossed, i.e., to cause all the embossing pins 81 to emboss at an equal interval (e.g., at every one second). Let us suppose that the raised-letter tape T is not fed at a constant speed. In case the problem lies in the embossed-tape feeding mechanism 62 in that the raised-letter tape T is not fed at a constant speed or, even in case there is no problem in the embossed-tape feeding mechanism 62 but in case there is a problem in that the embossing pins 81 do not return properly after having moved forward, whereby the head portion of the embossing pins 81 gets stuck with the rear recessed portion of the embossed projection 202, the following result will be obtained when the embossing operation is performed based on the third emboss-inspection pattern. Namely, although each of the embossing pins 81 embosses at an equal pitch, the raised-letter tape T is not fed at a constant speed, whereby the vertically arrayed three embossed projections 202 are formed out of alignment, i.e., in a manner offset in the feeding direction of the tape (right-and-left direction as seen in the figure; positional deviation in the embossed projections). The result is an embossed pattern (emboss-inspection pattern CHb) in which the vertically arrayed three embossed projections 202 are not formed at an equal pitch (raised-letter pitch Pd). In this manner, by performing the embossing operation based on the third emboss-inspection pattern, the problem in the embossed-tape feeding mechanism 62 or in the embossing unit 63 can be easily identified.

Figure 12A:
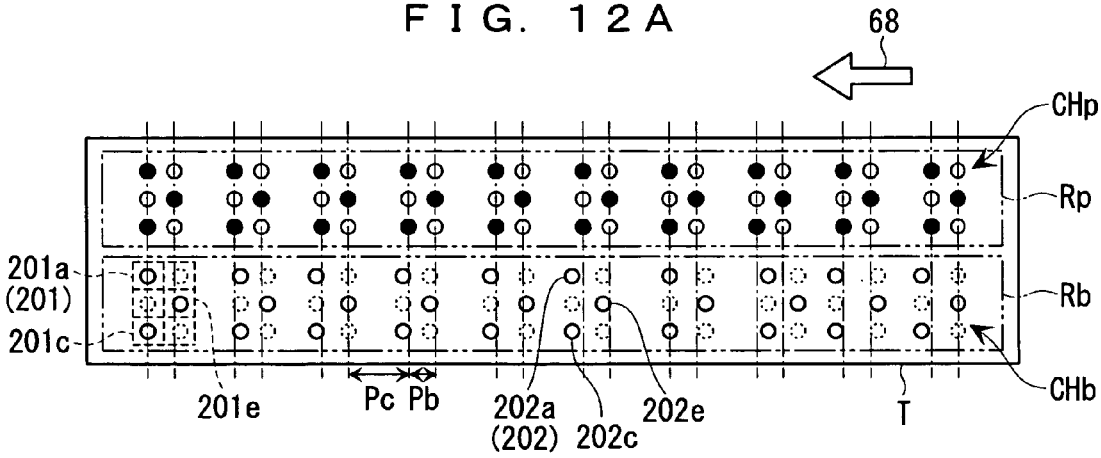
FIGS. 12A and 12B are schematic plan views of embossed results according to a fourth emboss-inspection pattern.
Figure 12B:
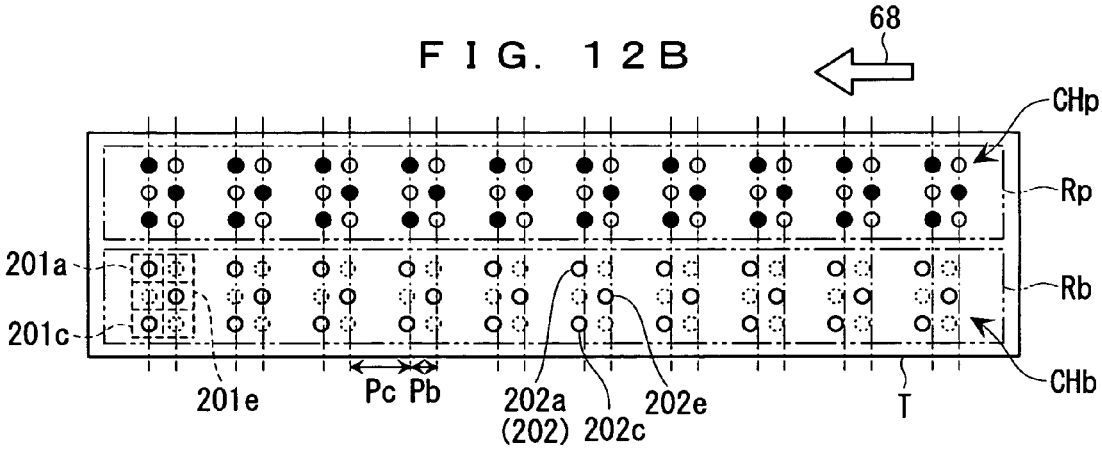

As shown in FIG. 12, the fourth emboss-inspection pattern has a bit pattern to cause the embossing points 201*a*, 201*c*, 201*e* of the first and third stages on the first row and the second stage on the second row, out of the embossing points 201, to be embossed, i.e., to cause the first embossing pin 81*a*, the third embossing pin 81*c* and the second embossing pin 81*b* to emboss alternatively and at an equal pitch (e.g., at every one second). Let us suppose that the raised-letter tape T is not fed at a constant speed. In case the problem thus lies in the embossed tape feeding mechanism 62 in that the raised-letter tape T is not fed at a constant speed, the following result will be obtained when the embossing operation is performed based on the fourth emboss-inspection pattern. Namely, in the same manner as in the third emboss-inspection pattern, the embossed projections 202*a*, 202*c* of the first and third stages as well as the embossed projection 202*e* of the second stage are formed out of alignment, i.e., in a manner offset in the feeding direction of the tape (right-and-left direction as seen in the figure). In other words, the embossed projections 202*a*, 202*c* of the first and third stages are formed without a frame pitch Pc relative to the embossed projection 202*e* of the second stage which lies ahead as seen in the tape feeding direction (left in the figure). And the embossed projection 202*e* of the second stage is formed without a pitch Pb between rows relative to the embossed projections 202*a*, 202*c* of the first and third stages which lie ahead as seen in the tape feeding direction (the obtained result is referred to as emboss-inspection pattern CHb; see FIG. 12A).

Let us suppose that there is no problem in the embossing tape feeder 62 but that there is a problem in that the up and down movement, e.g., of the second embossing pin 81*b* is not properly performed, resulting in a failure of feeding the raised-letter tape T at a constant speed. If the embossing operation is performed based on the fourth emboss-inspection pattern in such a state, the raised-letter tape T is fed for a distance which is smaller than the predetermined distance, when the first embossing pin 81*a* and the third embossing pin 81*c* emboss at the embossing points 201*a*, 201*c* of the first row. As a result, the embossed projections 202*a*, 202*c* of the first and third stages are formed, relative to the embossed projection 202*e* of the second stage, with a distance which is smaller than the pitch Pc between frames. The embossed projection 202*e* of the second stage is formed, relative to the embossed projections 202*a*, 202*c* of the first and third stages, at a pitch Pb between rows (emboss-inspection pattern CHb; see FIG. 12B). In other words, the way of deviation of the embossed projections 202 varies between the case where the embossed tape feeding mechanism 62 has a problem and a case where the embossing unit 63 has a problem. It follows that, by performing embossing operation based on the fourth emboss-inspection pattern, it can be easily identified as to which of the embossed tape feeding mechanism 62 and the embossing unit 63 has the problem and as to which of the embossing pins 81 has the problem.

In the manner described hereinabove, there are provided the emboss-inspection pattern to identify the problem in the control section 107, the emboss-inspection pattern to identify the problem in the embossing unit 63, and the emboss-inspection pattern to identify the problem in the embossed tape feeding mechanism 62, and an arbitrary emboss-inspection pattern can be selected out of the above-described emboss-inspection patterns. Therefore, it is possible to surely identify the point where the problem lies, and also to easily and quickly set the embossed-inspection patterns. The ease of operation on the part of the user can thus be improved.

As described above, according to the label forming apparatus 1 of this invention, embossing operation is performed on the raised-letter tape T based on the emboss-inspection pattern which is made up of a repetition of predetermined bit patterns. Therefore, the portion in which a trouble of embossing operation has occurred can be accurately identified based on the result of embossing thereof. It follows that no particular skill is required in determining the portion of occurrence of the trouble. This brings about an efficient repair of the apparatus.

What is claimed is:

1. An apparatus for processing a target sheet comprising:

embossing means for embossing raised letters on the target sheet to be fed, said raised letters being formed by selectively driving a plurality of embossing pins arrayed in a direction perpendicular to a direction of feeding the target sheet such that the raised letters are represented in a projected bit pattern which is embossed at embossing points of a plurality of stages in two rows;

emboss-inspection mode setting means for setting an emboss-inspection mode in which inspection is made whether an embossing operation for forming the raised letters is normal or not;

emboss-inspection pattern storing means for storing an emboss-inspection pattern which is made up of a repetition of a predetermined bit pattern; and control means for controlling said embossing means to perform embossing operation based on the emboss-inspection pattern when the emboss-inspection mode is set.

2. The apparatus according to claim 1, further comprising printing means for printing on the target sheet to be fed, wherein, when the emboss-inspection mode is set, said control means controls said embossing means and said printing means to thereby cause the embossing operation to be performed based on the emboss-inspection pattern and cause the printing operation to be performed based on a print-inspection pattern which is equal to the emboss-inspection pattern.

3. The apparatus according to claim 2, further comprising:

embossing-region setting means for setting a position of an embossing region in which the embossing operation is performed on the target sheet; and printing-region setting means for setting a printing region in which the printing operation is performed on the target sheet.

4. The apparatus according to claim 1, wherein said emboss-inspection pattern storing means stores therein plural kinds of the emboss-inspection patterns, said apparatus further comprising selecting means for selecting one emboss-inspection pattern out of the plural kinds of emboss-inspection patterns, wherein said control means controls the embossing operation based on the emboss-inspection pattern selected by said selecting means.

5. The apparatus according to claim 4, wherein said plural kinds of emboss-inspection patterns include one in which the bit pattern thereof embosses, out of the embossing points of a plurality of stages in two rows, at the embossing point of an arbitrary stage of each row.

6. The apparatus according to claim 4, wherein said plural kinds of emboss-inspection patterns include one in which the bit pattern thereof embosses at all of the embossing points of the plurality of stages in two rows.

7. The apparatus according to claim 4, wherein said plural kinds of emboss-inspection patterns include one in which the bit pattern thereof embosses, out of the embossing points of a plurality of stages in two rows, at the embossing points of all stages of one row.

8. The apparatus according to claim 4, wherein said plural kinds of emboss-inspection patterns include one in which the bit pattern thereof embosses, out of the embossing points of a plurality of stages in two rows, at the embossing point or points of an arbitrary one or a plurality of stages in the first row and embosses at remaining embossing point or points of other stage in the second row.

9. A method of controlling embossing by an apparatus for processing a target sheet in which raised letters are formed by selectively driving a plurality of embossing pins arrayed in a direction perpendicular to a direction of feeding the target sheet such that the raised letters are represented in a projected bit pattern which is embossed at embossing points of a plurality of stages in two rows, comprising:

setting an emboss-inspection mode and determining whether an embossing operation is normal or not by controlling an embossing means to perform an embossing operation based on an emboss-inspection pattern which is made up of a repetition of the bit pattern.

* * * * *